US005492476A

United States Patent [19]

Ball et al.

[11] Patent Number: 5,492,476

[45] Date of Patent: Feb. 20, 1996

[54] FOLD OUT DISPLAY

[75] Inventors: Douglas C. Ball, Senneville, Canada; Lon D. Scheerhorn, Byron Center, Mich.

[73] Assignee: Steelcase Inc., Grand Rapids, Mich.

[21] Appl. No.: 255,486

[22] Filed: Jun. 8, 1994

[51] Int. Cl.[6] ..... B43L 1/00

[52] U.S. Cl. ..... 434/408; 40/605; 434/414; 434/428

[58] Field of Search ..... 434/414, 413, 434/408, 419, 421, 431; 24/487, 543; 40/539, 605, 610; 160/113, 114; 16/225, DIG. 13; 403/106, 104, 326

[56] References Cited

U.S. PATENT DOCUMENTS

| | | | |
|---|---|---|---|
| 138,714 | 5/1873 | Thomson | 434/408 X |
| 489,518 | 1/1893 | Ambruster . | |
| 513,080 | 1/1894 | Butler . | |
| 616,799 | 12/1898 | McCollum | 434/414 |
| 752,990 | 2/1904 | Miller . | |
| 957,583 | 5/1910 | Tindall . | |
| 1,037,233 | 9/1912 | Furrow . | |
| 1,180,057 | 4/1916 | McNamara . | |
| 1,825,716 | 10/1931 | Courtenay . | |
| 2,693,655 | 11/1954 | Tschiedel | 40/125 |
| 2,744,712 | 5/1956 | Brandt | 403/104 X |
| 3,100,573 | 8/1963 | Cox | 211/177 |
| 3,226,863 | 1/1966 | Southard | 40/120 |
| 3,232,370 | 2/1966 | Jaffe | 181/30 |
| 3,370,821 | 12/1968 | Mingis | 248/452 |
| 3,445,052 | 5/1969 | Lewallen | 16/DIG. 13 |
| 3,623,691 | 11/1971 | Percy | 248/454 |
| 3,630,309 | 12/1971 | Wenger et al. | 181/30 |
| 3,889,736 | 6/1975 | Firks | 16/225 X |
| 4,085,867 | 4/1978 | Heller | 222/181 |
| 4,222,544 | 9/1980 | Crowder | 248/495 |
| 4,317,606 | 3/1982 | Hastings | 312/231 |
| 4,372,631 | 2/1983 | Leon | 312/231 |
| 4,544,123 | 10/1985 | Peacock | 248/460 |
| 4,667,833 | 5/1987 | Jamison | 211/198 |
| 4,711,046 | 12/1987 | Herrgord | 40/605 |
| 4,744,762 | 5/1988 | Konsuvo | 434/412 |
| 4,794,712 | 1/1989 | Wood | 40/605 |
| 4,828,502 | 5/1989 | Leahy | 434/421 X |
| 4,969,623 | 11/1990 | Bernier | 248/441.1 |
| 5,037,057 | 8/1991 | Andrews | 248/440 |
| 5,039,053 | 8/1991 | Boeshart | 16/225 X |
| 5,115,855 | 5/1992 | Lindblom et al. | 40/605 X |
| 5,131,849 | 7/1992 | Perrero | 434/281 |
| 5,244,267 | 9/1993 | Fossier, Jr. et al. | 312/231 |
| 5,355,555 | 10/1994 | Zarelius | 16/225 |

*Primary Examiner*—Robert A. Hafer
*Assistant Examiner*—Michael O'Neill
*Attorney, Agent, or Firm*—Price, Heneveld, Cooper, DeWitt & Litton

[57] ABSTRACT

A fold out display is particularly adapted to support a wide variety of different types of group work activities, team projects, and the like, and includes a free standing base which fixedly supports a primary panel having an exterior display surface. At least one foldable panel is hingedly supported on the primary panel for movement between a closed folded position overlying the primary panel, and an open unfolded position protruding outwardly coplanar with the primary panel. The foldable panel includes at least an interior display surface which overlies the display surface of the primary panel when in the closed folded position. A one-piece living hinge has opposite side portions connected with the side edges of the primary and foldable panels, and is shaped such that when the foldable panel is shifted into the open unfolded position, the two display surfaces are juxtaposed in a substantially contiguous relationship to collectively provide an enlarged generally continuous and uninterrupted display. A fold out header panel assembly may be provided above the primary panels, and a pair of telescoping outstops help retain the folding panels in their open unfolded position.

51 Claims, 5 Drawing Sheets

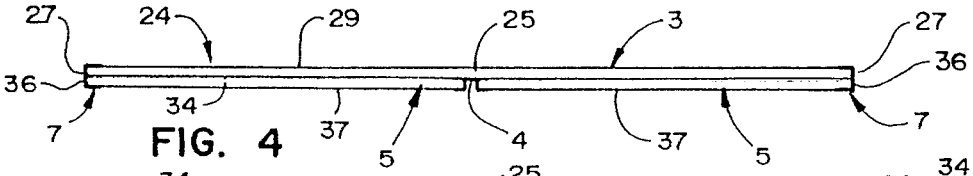
FIG. 4
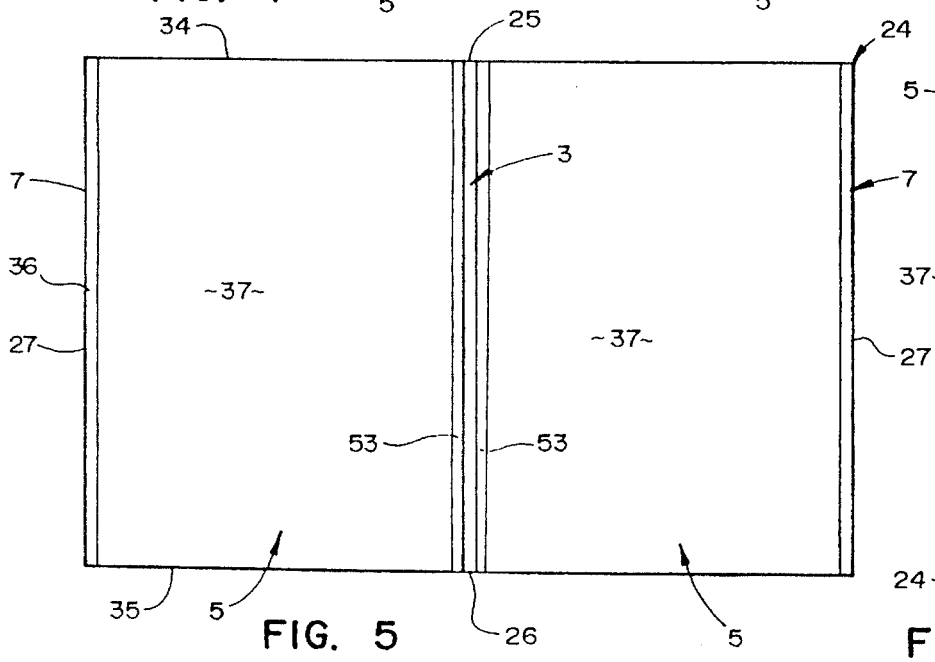
FIG. 5
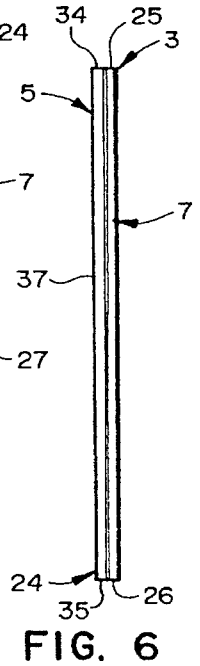
FIG. 6
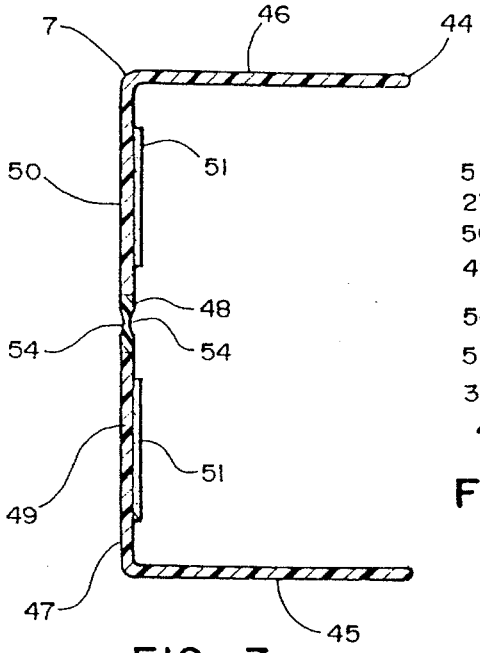
FIG. 7
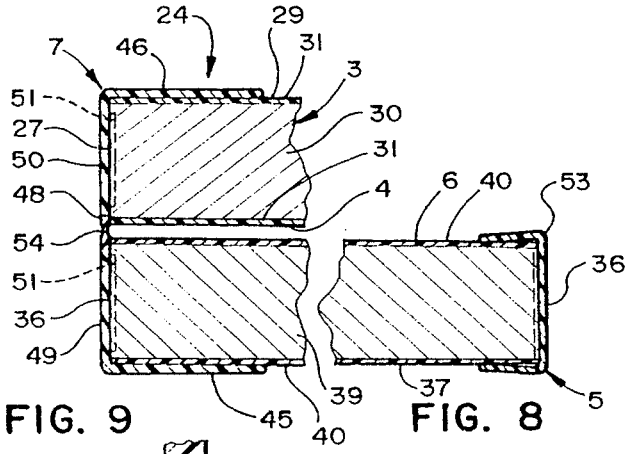
FIG. 9
FIG. 8
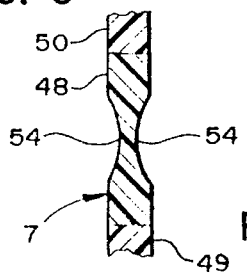
FIG. 10

FOLD OUT DISPLAY

BACKGROUND OF THE INVENTION

The present invention relates to displays, and in particular to a fold out display that is particularly adapted to support a wide variety of different types of group work activities, team projects, and other similar uses.

Displays are generally well known in the art, examples of which include stationary blackboards and/or marker boards for school classrooms or the like, as well as portable easels to retain flip charts, graphs, etc., for conference rooms, and other similar group areas. While such displays have proven generally effective for their intended environments, these uses are relatively limited. More specifically, prior art displays have a fixed size and shape, and are typically not very flexible and/or adaptable to permit them to be used effectively in conjunction with a wide variety of different settings, particularly with respect to group work activities and/or team projects.

Modern problem solving techniques involve group work, such as self-managed teams, or others involved in team problem solving techniques, wherein a relatively large number of workers from different disciplines, such as engineering, design, manufacturing, sales, marketing, purchasing, finance, etc. meet together as a group to define and review issues, and set general policy, and then break out into smaller sub groups or into individual assignments or projects to resolve those specific problems relating to their particular discipline. Group work is steadily gaining importance as a way of improving productivity and time-to-market, thereby emphasizing the need to support such activities more efficiently and effectively. Displays now play an important role in supporting group activities. The increased popularity of team problem solving and collaborative work styles creates the need for displays that are as quickly adaptable as today's workers, and are capable of addressing a broad range of communication styles and work process needs.

SUMMARY OF THE INVENTION

One aspect of the present invention is a fold out display, comprising a base configured to support the display in a freestanding fashion on an associated floor surface. A primary panel is fixedly supported on the base, and includes opposite side edges between which a display surface extends on an exterior side thereof. At least one foldable panel is hingedly supported on the primary panel for movement between a closed folded position wherein the foldable panel generally overlies the primary panel, and an open unfolded position wherein the foldable panel extends generally outwardly of the primary panel in a substantially coplanar relationship therewith. The foldable panel includes opposite side edges between which a display surface extends on an interior side thereof, which is disposed adjacent to the exterior side of the primary panel when the foldable panel is in the closed position. A one-piece living hinge is provided with opposite side portions thereof connected with adjacently positioned side edges of the primary and foldable panels, and includes a flexible center portion shaped such that when the foldable panel is shifted to the open unfolded position, the two display surfaces are juxtaposed in a substantially contiguous relationship to collectively provide an enlarged generally continuous and uninterrupted display.

Another aspect of the present invention is a fold out display, comprising a base configured to support the display in a fleestanding fashion on an associated floor surface. A primary panel is fixedly supported on the base, and includes opposite side edges between which a display surface extends on an exterior side thereof. At least one foldable panel is hingedly supported on the primary panel for movement between a closed folded position wherein the foldable panel generally overlies the primary panel, and an open unfolded position wherein the foldable panel extends generally outwardly of the primary panel in a substantially coplanar relationship therewith. The foldable panel includes opposite side edges between which a display surface extends on an interior side thereof, which is disposed adjacent to the exterior side of the primary panel when the foldable panel is in the closed folded position. A panel outstop is telescopingly mounted on the base for lateral translation between a retracted storage position, and an extended stop position, wherein the outstop engages the foldable panel in the open unfolded position to resist rearward movement therefrom.

Yet another aspect of the present invention is a fold out display, comprising a base configured to support the display in a freestanding fashion on an associated floor surface. A primary panel is fixedly supported on the base, and includes opposite side edges between which a display surface extends on an exterior side thereof. At least one foldable panel is hingedly supported on the primary panel for movement between a closed folded position wherein the foldable panel generally overlies the primary panel, and an open unfolded position wherein the foldable panel extends generally outwardly of the primary panel is a substantially coplanar relationship therewith. The foldable panel includes opposite side edges between which a display surface extends on an interior side thereof, which is disposed adjacent to the exterior side of the primary panel when the foldable panel is in the closed folded position. A header panel is fixedly supported on the base directly above the primary panel, and includes opposite side edges between which a display surface extends on an exterior side thereof.

Yet another aspect of the present invention is a fold out display, comprising a base configured to support the display in a freestanding fashion on an associated floor surface. A primary panel is fixedly supported on the base, and includes opposite side edges between which a display surface extends on an exterior side thereof. A header panel is fixedly supported on the base directly above the primary panel, and includes opposite side edges between which a display surface extends on an exterior side thereof. At least one foldable header panel is hingedly supported on the header panel for movement between a closed folded position wherein the foldable header panel generally overlies the header panel, and an open unfolded position wherein the foldable header panel extends generally outwardly of the header panel in a substantially coplanar relationship therewith. The foldable header panel includes opposite side edges between which a display surface extends on an interior side thereof, which is disposed adjacent to the exterior side of the header panel when the foldable header panel is in the closed folded position.

The principal objects of the present invention are to provide a fold out display that is particularly adapted to support a wide variety of different types of group work activities, team projects, and other similar needs. The display has a primary panel with an exterior display surface, and at least one foldable panel, hingedly connected to the primary panel, and having at least an interior display surface. The available display area can be easily varied by simply pivoting the foldable panel between a closed folded position, and an open unfolded position. The primary and foldable panels are hingedly interconnected by a one-piece living hinge, such that when the foldable panel is shifted to its open unfolded position, the two display surfaces are juxtaposed in a substantially contiguous relationship to form an enlarged, generally continuous uninterrupted display. Preferably, the display surfaces include erasable marker surfaces that permit marking indicia continuously thereacross. Retractable outstops securely retain each of the foldable panels in its open unfolded position to facilitate use as a writing surface. An auxiliary header can be provided on top of the primary board, and may also be equipped with foldable panels to further vary the available display area. The display is extremely durable, has a relatively uncomplicated design, and can be easily and quickly adjusted for a wide variety of different uses and needs. The display is efficient in use, economical to manufacture, capable of a long operating life, and particularly well adapted for the proposed use.

These and other advantages of the invention will be further understood by those skilled in the art by reference to the following written specification, claims and appended drawings.

BRIEF DESCRIPTION OF THE DRAWINGS

FIG. 4 is a top plan view of a primary panel assembly, wherein a primary panel has the two foldable panels hingeally mounted along opposite sides thereof.

FIG. 5 is a front elevational view of the primary panel assembly.

FIG. 6 is a side elevational view of the primary panel assembly.

FIG. 7 is an enlarged, lateral cross-sectional view of a living hinge for interconnecting the primary and foldable panels.

FIG. 8 is a fragmentary, horizontal cross-sectional view of the foldable panel, taken along the free edge thereof.

FIG. 9 is a fragmentary, horizontal cross-sectional view of the primary panel assembly, wherein the foldable panel is shown in its closed folded position.

FIG. 10 is an enlarged, fragmentary, lateral cross-sectional view of the hinge.

DETAILED DESCRIPTION OF THE PREFERRED EMBODIMENTS

Figure 1:
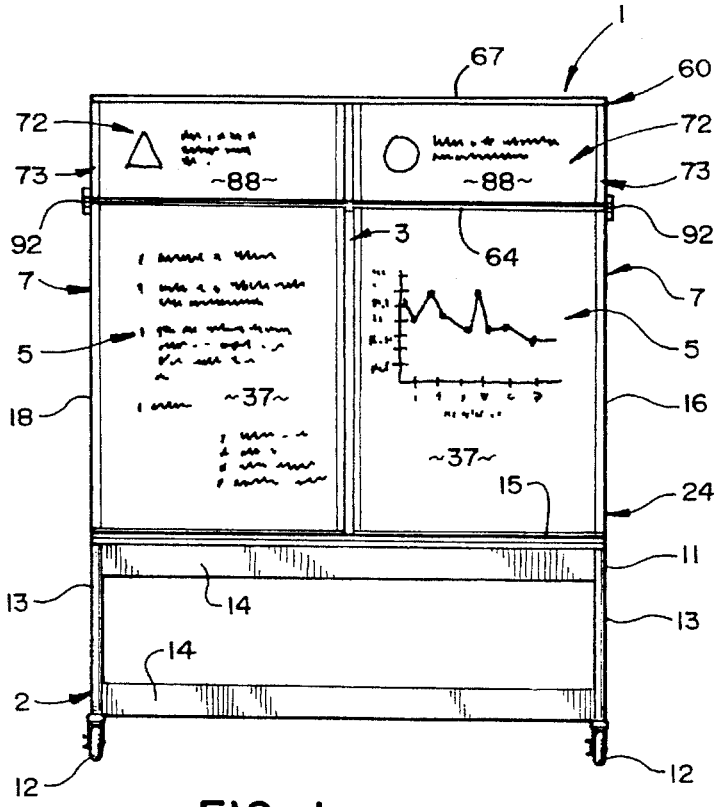
FIG. 1 is a front elevational view of a fold out display embodying the present invention, wherein a pair of foldable panels are shown in a closed folded position.
Figure 2:
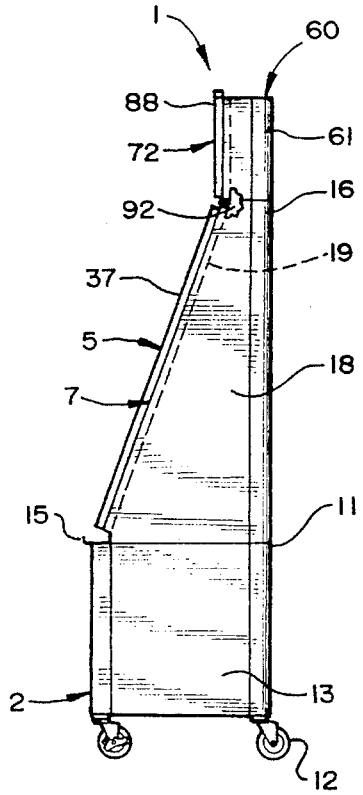
FIG. 2 is a side elevational view of the fold out display shown in FIG. 1.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various alternative orientations and step sequences, except where expressly specified to the contrary. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
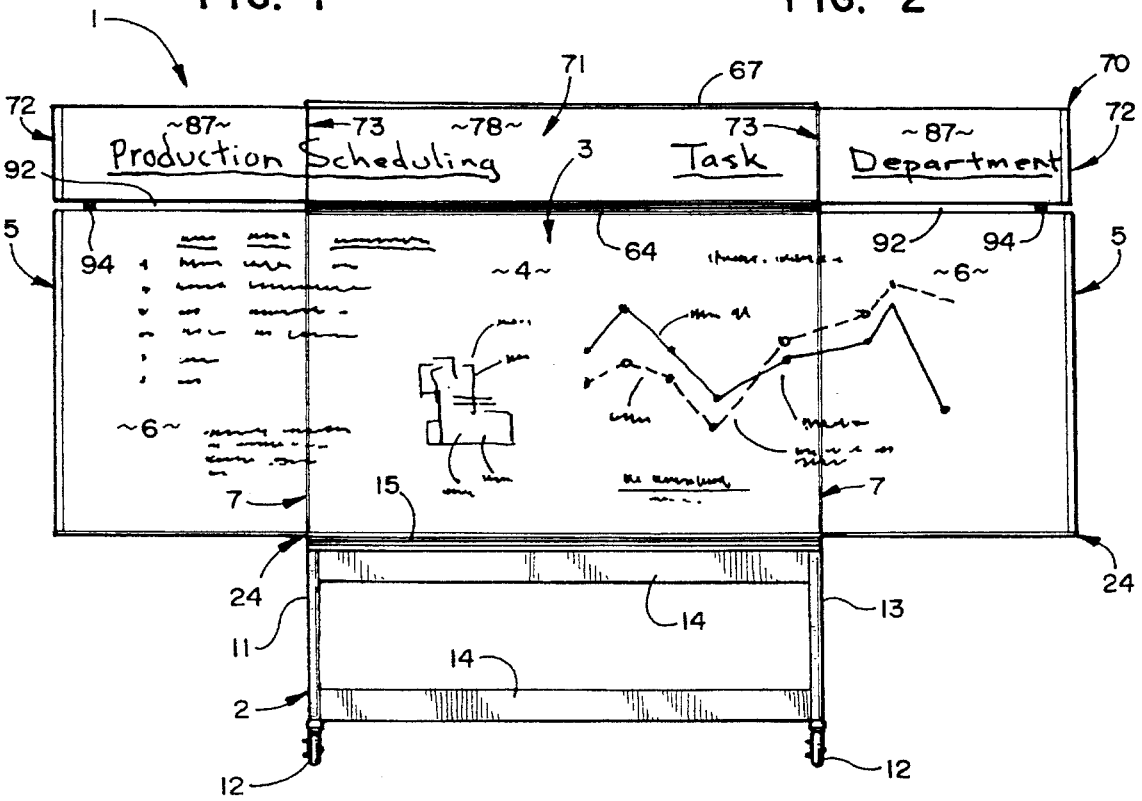
FIG. 3 is a front elevational view of the fold out display, wherein the foldable panels are shown in an unfolded open position.

The reference numeral 1 (FIGS. 1–3) generally designates a fold out display embodying the present invention. Display 1 includes a fleestanding base 2, which fixedly supports a primary panel 3 having an exterior display surface 4. At least one foldable panel 5 is hingedly supported on the primary panel 3 for movement between a closed folded position overlying primary panel 3, as shown in FIG. 1, and an open unfolded position protruding outwardly coplanar with primary panel 3, as shown in FIG. 3. Foldable panel 5 includes at least an interior display surface 6, which is disposed adjacent to the exterior display surface 4 of primary panel 3 when the foldable panel 5 is in its closed folded position. A one-piece living hinge 7 has opposite side portions thereof connected with the side edges of primary panel 3 and foldable panel 5, and is shaped such that when foldable panel 5 is shifted to the open unfolded position shown in FIG. 3, the two adjacent display surfaces 4 and 6 are juxtaposed in a substantially contiguous relationship to collectively provide an enlarged, generally continuous and uninterrupted display.

Figure 13:
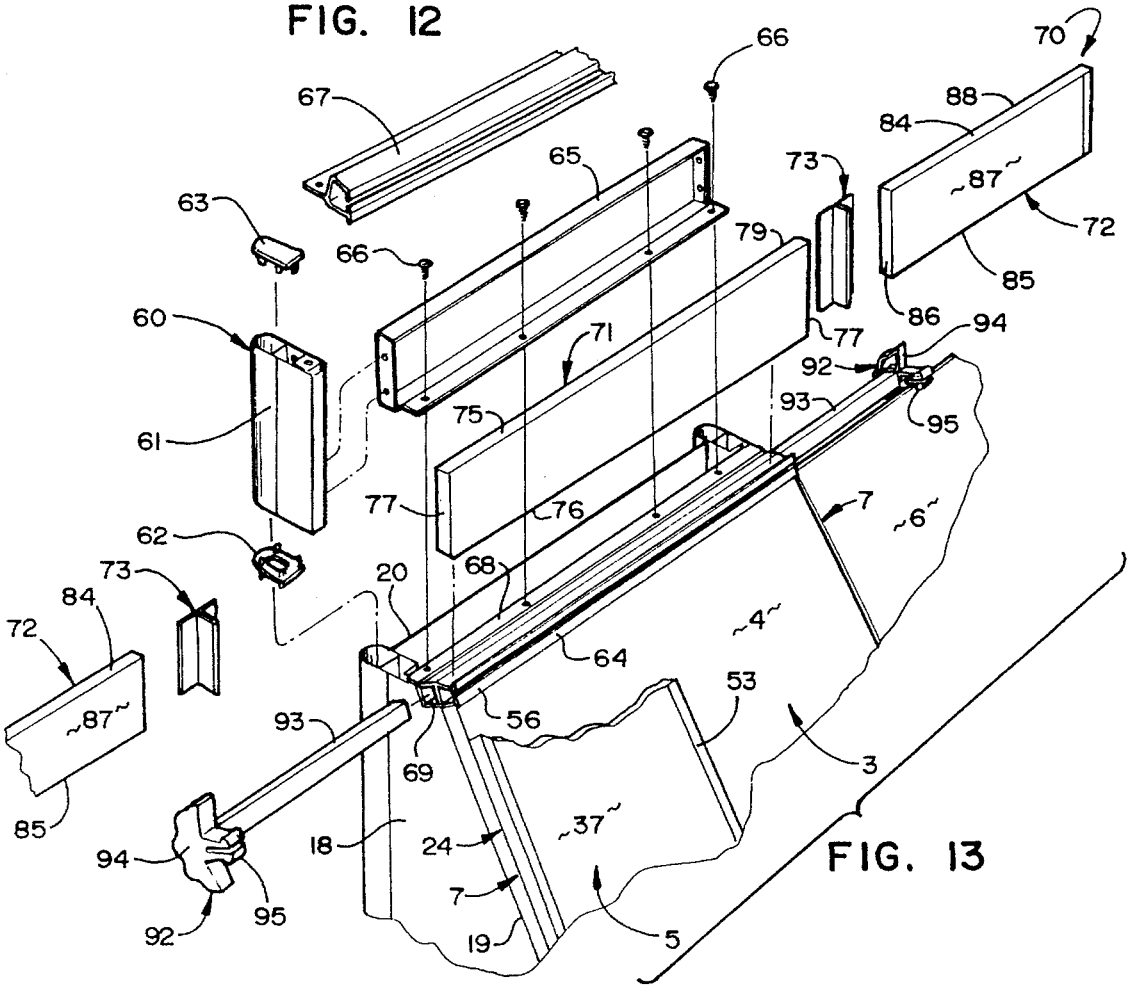
FIG. 13 is an exploded, perspective view of the fold out display, particularly showing a header panel assembly.

The illustrated base 2 (FIGS. 1–3) is supported on four casters 12 to permit fold out display 1 to be manually moved over an associated floor surface from one location to another. Mobile base 2 has a box-like lower portion 11, which includes a pair of opposite side panels 13, that are rigidly interconnected by two laterally extending shelves 14 located along the upper and lower portions of lower base 11. A tray-shaped channel 15 extends along the upper front edge of lower base 11, and provides a receptacle for writing instruments, and the like. Base 2 also includes an upper portion 16, having a pair of trapezoidally shaped end panels 18 projecting upwardly from side panels 13, with rearwardly inclined forward faces 19 on which panels 3 and 5 are supported. The lower ends of end panels 18 are fastened to the upper portions of side panels 13, and the upper ends of end panels 18 are rigidly interconnected by a laterally extending cross brace 20 (FIG. 13).

In the illustrated example, fold out display 1 (FIGS. 1–3) includes a pair of foldable wing panels 5, each of which has a height substantially equal to the height of primary panel 3, and a width equal to approximately one-half the width of primary panel 3. Hence, in the closed folded position illustrated in FIG. 1, the two foldable wing panels 5 have a shape and size that is commensurate with that of primary panel 3.

With reference to FIGS. 4–6, in the illustrated example, the primary panel 3 and the two foldable wing panels 5 are interconnected by a pair of living hinges 7, which collectively define a primary panel assembly 24 that is supported on base 2. The primary panel 3 has a substantially rectangular front elevational configuration, comprising a top edge 25, a bottom edge 26, and opposite side edges 27, as well as front face 4, and a rear face 29, which are generally planar and disposed in a mutually parallel relationship. The width of primary panel 3 is generally commensurate with the width of base 2, so as to maximize display efficiency. The front face 4 of primary panel 3 defines the exterior display surface thereof, as discussed below. In the illustrated example, primary panel 3 is a marker board, and includes a rigid core 30 (FIG. 9) having a pair of laminate cover sheets 31 forming the front and rear faces 4 and 29 thereof. Laminate sheets 3 each form an erasable marker surface.

The two foldable wing panels 5 are substantially identical, wherein each has a generally rectangular front elevational configuration, comprising a top edge 34, a bottom edge 35, and opposite side edges 36, as well as a front face 37, and rear face 6, which are generally planar and disposed in a mutually parallel relationship. The rear face 6 of wing panel 5 defines the interior display surface thereof, as discussed below. The illustrated wing panels 5 are also marker boards, and have a construction substantially similar to that of primary panel 3, and include a rigid core 39, with a pair of laminate cover sheets 40 forming the front and rear faces 37 and 6 thereof. Laminate sheets 40 each form an erasable marker surface, such that wing panels 5 are double sided.

In the primary panel assembly 24, the primary panel 3 and the two wing panels 5 are hingeally interconnected by a pair of living hinges 7. Living hinges 7 are substantially identical, and in the example illustrated in FIGS. 7–10, comprise an extruded U-shaped channel 44, having front and rear flanges 45 and 46, and an end web 47. The illustrated hinge web 47 is relatively thin, and has a center portion 48 with a reduced thickness to provide additional flexibility to living hinge 7, and defines on opposite sides thereof a front web portion 49, and a rear web portion 50. Hinge center portion 48 is formed by a pair of arcuate grooves 54 extending along opposite sides of web 47. In the illustrated example, hinge 7 has an extruded, dual durometer type of construction, wherein the center portion 48 of hinge 7 is constructed from a relatively soft synthetic resin material, such as Hytrel, whereas the balance of the hinge is formed from a more rigid material, such as a polyvinyl chloride. In this fashion, the opposite L-shaped portions of the hinge 7 are more rigid to better capture the side edges of the various panels 3 and 5 therein, whereas the center portion 48 is more pliable to permit readily folding the wing panels 5 between the open and closed positions. The front and rear portions 49 and 50 respectively of the illustrated hinge web 47 both include an elongate adhesive strip 51 in the form of a foam tape or the like, which mounts hinge 7 to marker board panels 3 and 5. Other types of fastener arrangements can also be used, as described in greater detail below.

In the construction of the illustrated primary panel assembly 24, a pair of living hinge strips 7 are mounted on the opposite side edges 27 of primary panel 3 by adhering rear adhesive strips 51 to the primary panel side edges 27. A pair of wing panels 5 are assembled overlying primary panel 3, and the exterior side edges 36 of each are mounted on hinge strips 7 by adhering the same to the front adhesive strips 51, such that the assembly assumes the configuration shown in FIGS. 4–6 and 9. A protective edge guard strip 53 is mounted along the interior or free side edges 27 of wing panels 5 to finish and protect the exposed surfaces.

Figure 14:
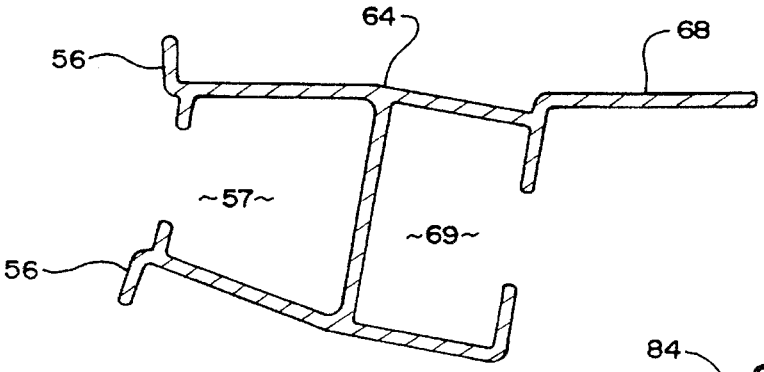
FIG. 14 is a lateral cross-sectional view of a support channel.
Figure 16:
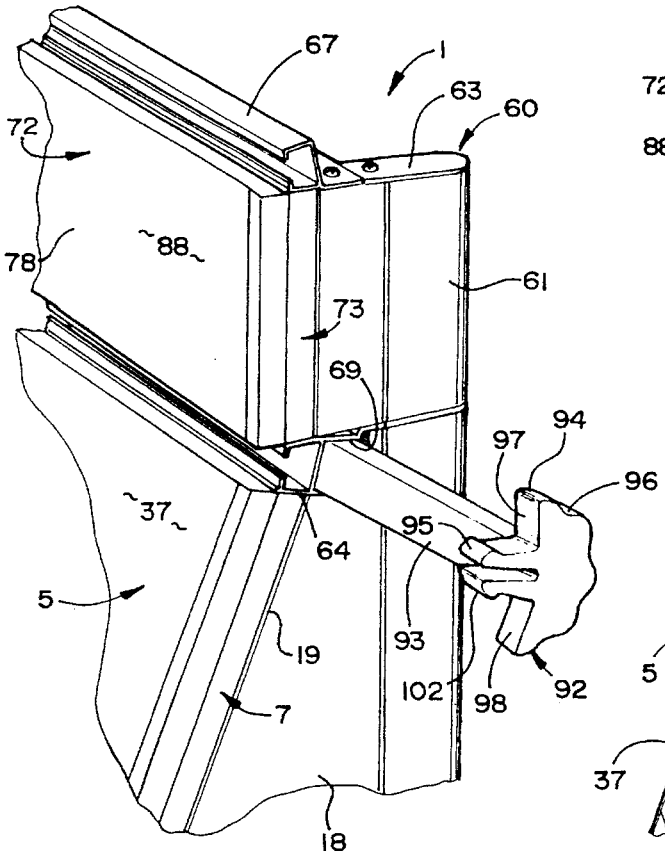
FIG. 16 is a fragmentary, perspective view of the fold out display, wherein a panel outstop portion thereof is shown in a fully extended position.
Figure 15:
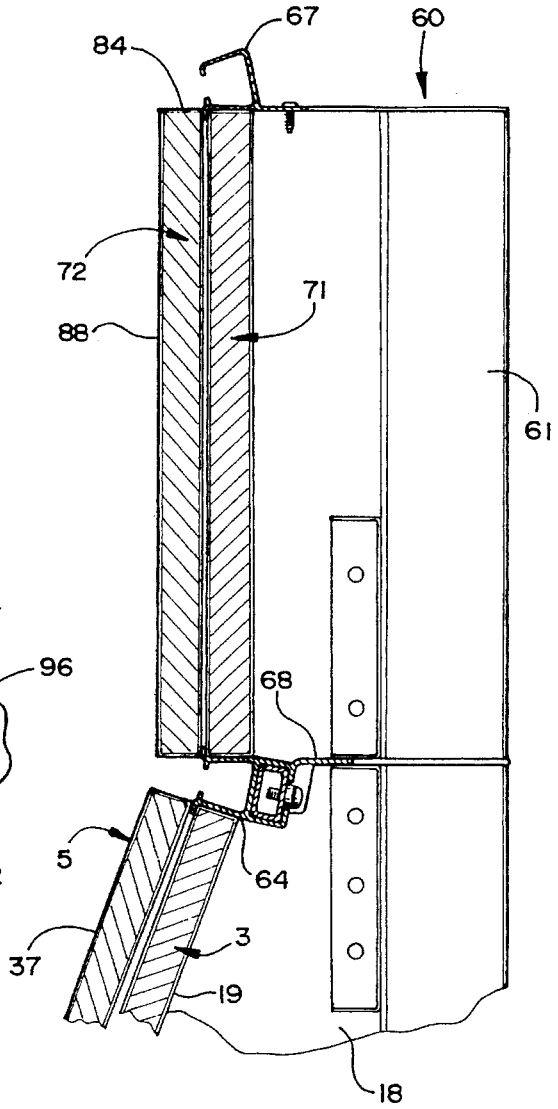
FIG. 15 is a fragmentary, vertical cross-sectional view of the fold out display.

The illustrated fold out display 1 includes a margin or header assembly 60 (FIGS. 1–3), which provides additional display space above primary panel assembly 24, and is detachable, such that it can be offered as an option to the basic display unit. With reference to FIG. 13, the illustrated header assembly 60 includes a pair of end posts 61, which are mounted on top of base end panels 18, and project upwardly therefrom. End posts 61 are substantially identical, and each includes a pad 62 mounted in the lower end thereof, and a cap 63 mounted in the upper end thereof. A lower hanger channel 64 extends along the upper edge of primary panel assembly 24, and the opposite end post 61 are rigidly interconnected by a laterally extending cross channel 65 that is fastened to hanger channel 64 and primary panel assembly 24 by fasteners 66. A top hanger channel 67 extends along the top edge of header assembly 60. With reference to FIGS. 14–16, lower hanger channel 64 includes a laterally extending mounting flange 68, and is in the form of an H-shaped channel that defines a longitudinally extending, rectangular socket 69, and a pair of outer lips 56 which flare vertically in opposite directions. An open sided groove 57 is formed in the forward portion of channel 64, and is shaped to detachably receive a variety of different types of removable hanger clips (not shown) therein for flip charts, sheet graphs, projection screens, and the like. Upper hanger channel 67 has a similar forward construction to support such accessories (not shown).

The primary panel assembly 24 is fixedly supported on base 2 in a manner which permits wing panels 5 to shift independently between the open and closed positions. More specifically, the bottom edge 26 of primary panel 3 is abuttingly supported on tray channel 15, and the rear face 29 of primary panel 3 is supported on the inclined flanges 19 of upper base 16 along the side edges 27 thereof. Hence, primary panel assembly 24 is retained on base 2 in a rearwardly inclined orientation to facilitate display uses. The top edge 25 of primary panel 3 is captured by lower hanger channel 64, as shown in FIGS. 15 & 16. Primary panel assembly 24 may be removed from base 2 and replaced should the display surfaces become damaged.

Header assembly 60 (FIGS. 1–3) includes a header panel assembly 70, comprising a primary header panel 71, and a pair of foldable wing header panels 72 that are hingeally interconnected by a pair of living hinge strips 73. The illustrated header panels 71 and 72 are marker boards that are substantially identical to the primary marker board panels 3 and 5, except that they have a shorter height, and are oriented vertically. More specifically, primary header panel 71 (FIG. 13) has a width and thickness substantially identical to primary panel 3, with a substantially rectangular plan configuration that includes a top edge 75, a bottom edge 76, and a pair of opposite side edges 77, as well as front and rear faces 78 and 79 respectively, which are generally planar and disposed in a mutually parallel relationship. At least the front face 78 of primary header panel 71 is a display, which in the illustrated example is an erasable marker surface. The foldable wing header panels 72 are substantially identical, and each has a generally rectangular front elevational configuration defined by a top edge 84, a bottom edge 85, and opposite side edges 86, as well as front and rear faces 87 and 88 respectively, which are generally planar and disposed in a mutually parallel relationship. Both the front and rear faces 87 and 88 of both of the foldable wing header panels 72 has an erasable marker surface, such that wing panels 72 are also double sided.

Foldable wing header panels 72 each has a height substantially equal to the height of primary header panel 71, and a width equal to approximately one-half of the width of primary header panel 71. Hence, in the closed folded position illustrated in FIG. 1, the two foldable wing header panels 72 have a shape and size that is commensurate with that of primary header panel 71.

The panels 71 and 72 of header panel assembly 70 are interconnected by the two living hinge strips 73 in a fashion substantially identical to primary panel assembly 24. Consequently, wing header panels 72 can be pivoted between the closed folded position shown in FIG. 1, and the open unfolded position shown in FIG. 3. Hinge strips 73 are identical to hinge strips 7, except that they are shorter.

Figure 12:
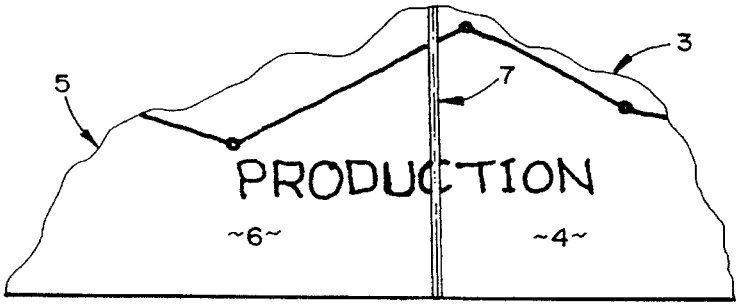
FIG. 12 is a fragmentary, front elevational view of the panel assembly, wherein the foldable panel is shown in its open unfolded position, with indicia marked across the hinge.

The unique construction of living hinges 7 & 73, in conjunction with the borderless construction of marker boards 3, 5, 72 & 73, causes display surfaces 4 & 6 on primary panels 3 & 5 and display surfaces 78 & 87 on header panels 71 & 72 to be juxtaposed when unfolded to form an enlarged generally continuous and uninterrupted display that permits marking indicia thereacross, as shown in FIG. 3 & 12. More specifically as to hinges 7, the web portions 49 and 50 of hinge 7 are relatively thin, such that when the wing panels 5 are pivoted to their open unfolded position, the adjacent side edges 27 & 36 of panels 3 & 5 are positioned in very close proximity. The reduced thickness at hinge center 48 formed by channels 54, and soft plastic material also help to insure this closely edging relationship, such that the adjacent marker surfaces 4 & 6 are substantially contiguous. Since panels 3 & 5 are totally borderless, and hinges 7 do not extend over any portion of panel surfaces 4 & 6, the user can mark across surfaces 4 & 6, as shown in FIGS. 3 & 12, without interruption, thereby providing for more effective use of the associated display area. The display surfaces 78 & 87 on header panels 71 & 72 function similarly.

It is to be understood that different types of fastener arrangements can be used to mount living hinges 7 & 23 to the side edges of the various panels 3, 5, 72 & 73, while maintain the close edging relationship discussed above, so that the laterally adjacent display surfaces 4 & 6 and 78 & 87 are substantially contiguous. For example, in lieu of the illustrated adhesive strips 51, screws with low profile, countersunk heads can be inserted through hinge portions 50 and 51, and anchored in the core 30 of the adjacent panels 3, 5, 72 & 73. An adhesive coating or bead can also be provided on the interior surfaces of hinges 7 & 23, with or without screws, or other similar fasteners. Other types of fastening mechanisms can also be used, so long as the close edging relationship between adjacent panels 3, 5, 72 & 73 is maintained when the wing panels 5 & 72 are in their open unfolded positions.

Figure 11:
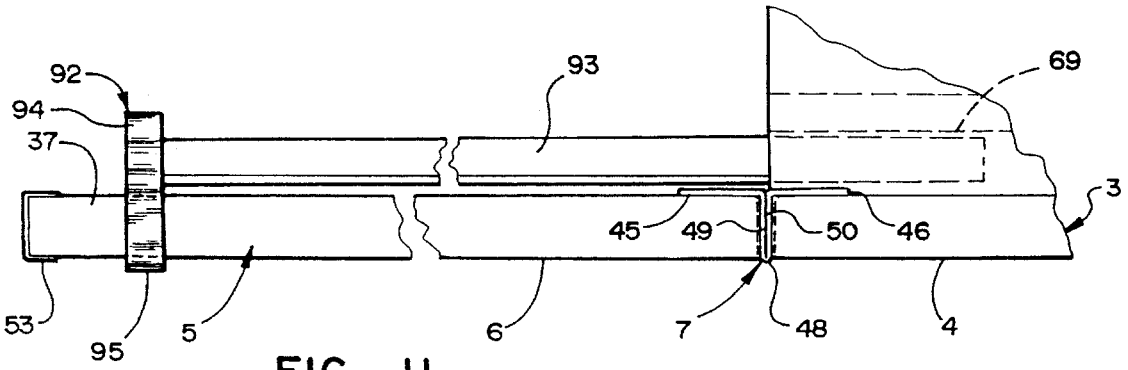
FIG. 11 is a fragmentary, horizontal cross-sectional view of the primary panel assembly, wherein the foldable panel is shown in its open unfolded position.
Figure 18:
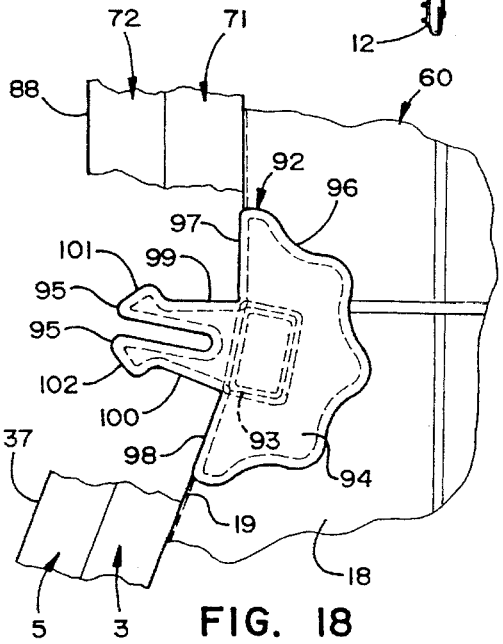
FIG. 18 is a fragmentary side elevational view of the fold out display, wherein the panel outstop is shown in its fully retracted position, with the foldable panels in their closed folded position.
Figure 19:
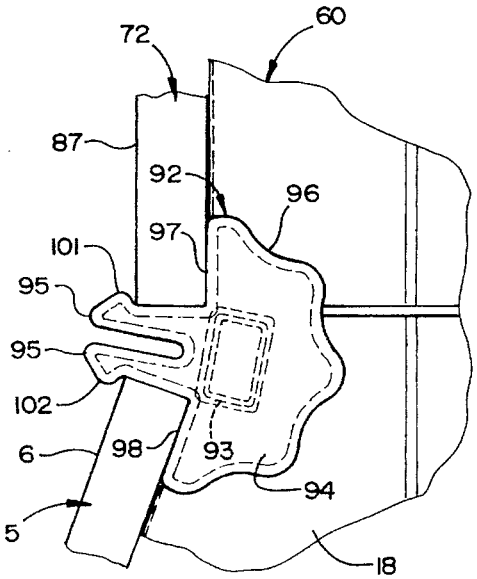
FIG. 19 is a fragmentary side elevational view of the fold out display, wherein the panel outstop is shown in its fully extended position, with the foldable panels in their fully open unfolded position.

A pair of telescopingly wing supports 92 (FIGS. 1–3) are provided to support the four wing panels 5 and 72, so as to prevent the same from rotating rearwardly beyond their fully open unfolded positions, and thereby facilitate use as writing surfaces. Wing supports 92 are substantially identical in construction, and each includes an elongate tube 93 (FIGS. 11 & 13) having a rectangular lateral cross-sectional shape that is telescopingly received within the socket 69 of lower hanger channel 64. An outstop 94 is mounted on the outer end of tube 93, and includes a pair of resiliently flexible fingers 95 which project forwardly to engage the adjacent edges of wing panels 5 and 72, as described below. As best illustrated in FIGS. 18 and 19, each outstop 94 has an undulating or corrugated rear edge 96 in the form of a grip, and a pair of flat forward edges 97 and 98 which function as stops. Resilient fingers 95 include outer edges 99 and 100, which terminate in barb-shaped ends 101 and 102.

Figure 17:
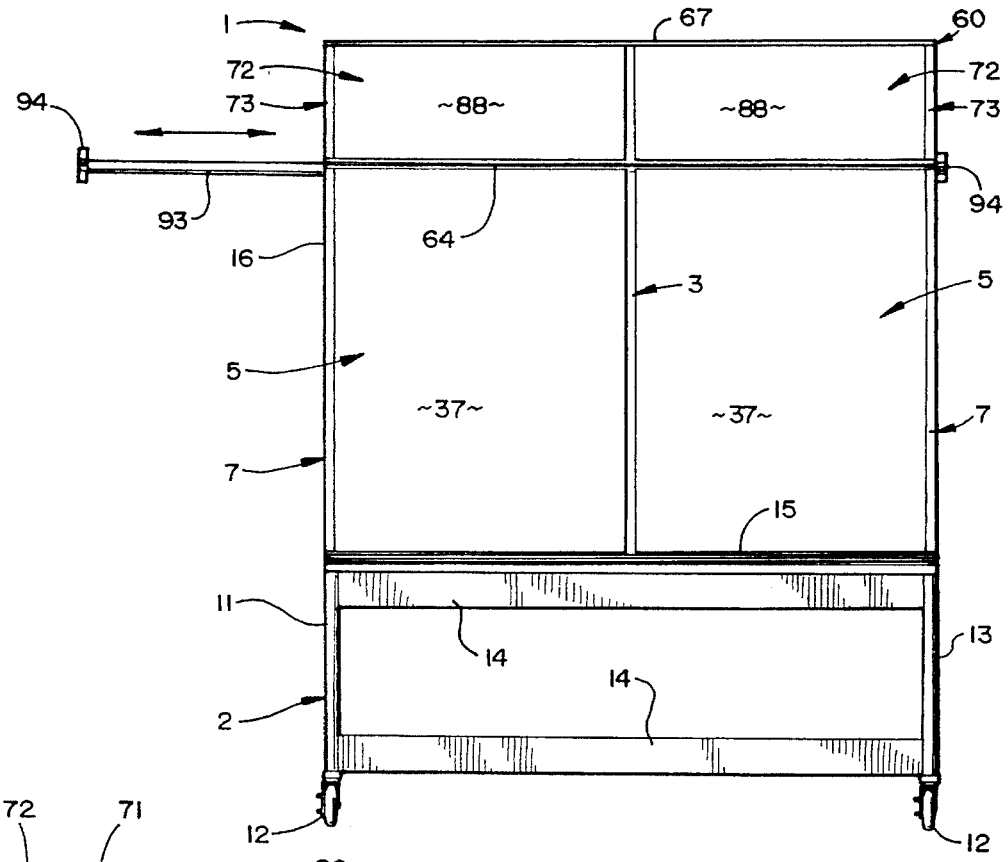
FIG. 17 is a front elevational view of the fold out display, wherein the left hand panel outstop is shown in a fully extended position, and the right hand panel outstop is shown in a fully retracted position.

In operation, wing supports 92 can be slid laterally or telescopingly extended to provide support for the associated wing panels 5 and/or 72 when they are pivoted outwardly to their open unfolded position. For example, with reference to FIGS. 11 & 17, when one or both of the left hand wing panels 5 and 72 is to be shifted from the closed folded position to the open unfolded position, the operator first extends the associated left hand wing support 92 from its normally retracted position to the illustrated fully extended position. When the left hand primary wing panel 5 is pivoted outwardly to its fully open unfolded position, the upper edge 34 of primary wing panel 5 passes over the barb 102 on outstop finger 100, deflecting the same upwardly such that the upper edge 34 of header wing panel 72 engages edge 100, and the rear surface 6 of primary wing panel abuts surface 98 of outstop 94, so as to prevent further rearward rotation. As primary wing panel 5 clears finger barb 102, barb 102 resiliently snaps back to its normally extended position, so as to form a catch that prevents primary wing panel 5 from being inadvertently shifted from its fully open unfolded position. In a similar fashion, when the left hand header wing panel 72 is shifted from its closed folded position to its fully open unfolded position, the lower edge 85 thereof deflects over the barb 102 on outstop finger 95, deflecting the same downwardly, such that the lower edge 85 of header wing panel 72 engages edge 99, and the rear surface of header wing panel 72 abuts surface 97 of outstop 94, so as to prevent further rearward rotation. As the lower edge 85 of header wing panel 72 clears finger barb 101, barb 101 resiliently snaps back to its normal position, so as to form a catch that assists in preventing header wing panel 72 from becoming inadvertently shifted from its fully open unfolded position. The wing panels 5 and 72 can be shifted back to their closed folded position by simply reversing the sequence of steps described above, and telescoping wing support 92 is manually shifted back to its fully retracted position adjacent side of base 2. A conventional spring catch (not shown) may be provided at the upper center portion of primary header panel 71 to selectively retain header wing panels 72 in their closed position, particularly during transport.

In use, fold out display 1 can be readily adapted to support a wide variety of different types of group work activities, team projects, and other similar needs and/or situations. Initially, the casters 12 on base 2 render fold out display 1 portable, so that it can be readily transported to any desired location, and then oriented conveniently with respect to the various users.

Fold out display 1 is in the nature of an activity wall or easel, which is capable of supporting multiple displays. While the illustrated ten display surfaces 4, 6, 37, 78, 87 & 88 of borderless panels 3, 5, 71 & 72 are marker boards, it is to be understood that the present invention also contemplates other forms of displays, such as blackboards, and other writing surfaces, as well as electronic displays, etc.

Because the exterior faces 37 & 88 of wing panels 5 and 72 respectively, are equipped with marker surfaces, the users can apply indicia or other displays on these surfaces while fold out display 1 is in its compact closed folded condition. The header wing panels 72 provide convenient locations directly above primary wing panels 5 for special notation indicia, such as topic headings, and the like. Should the exterior faces 37 & 88 of wing panels 5 and 72 become filled, or the users wish to proceed to a different topic, the users can access additional unused display area by simply unfolding one or more of the foldable wing panels 5 and 72. In the example illustrated in FIG. 3, all four of the foldable wing panels 5 and 72 have been shifted to their fully open unfolded position by extending both wing supports 92 in the fashion described above. Because the interior faces 4 & 6 of foldable wing panels 5 and 72 each have an erasable marker surface, a greatly expanded display area is accessed by unfolding wing panels 5 and 72. Furthermore, the unique construction of living hinges 7 is such that when the primary wing panels 5 are shifted to their open unfolded position, the display surface 4 on the primary panel 3 and the display surfaces 6 on the primary wing panels 5 are juxtaposed in a substantially contiguous relationship to collectively provide an enlarged generally continuous and uninterrupted display that permits marking indicia continuously thereacross, as shown in FIGS. 3 and 12. Similarly, living hinges 72 are uniquely shaped such that when header wing panels 72 are shifted to their open unfolded position the display surface 78 on primary header panel 71 and the display surfaces 87 on header wing panels 72 are juxtaposed in a substantially contiguous relationship to selectively provide an enlarged generally continuous and uninterrupted display that permits marking indicia continuously thereacross as shown in FIG. 3.

Fold out display 1 is thereby particularly adapted to support a wide variety of different types of group activities, team projects, and other similar needs. A normally compact, mobile unit in the condition shown in FIG. 1, permits marking, or other displays, on four separate board surfaces 37 & 88. By opening wing panels 5 & 70 to the condition shown in FIG. 3, another set of six board surfaces 4, 6, 78 & 87 are accessed, which have a total area that is approximately twice that of the area of front surfaces 37 & 88. Furthermore, the unique construction of living hinges 7 and 73 causes the display surfaces 4 & 6, as well as 78 & 87 to be juxtaposed when unfolded to form enlarged generally contiguous and uninterrupted displays that permit marking indicia continuously thereacross. The two telescoping wing supports 92 provide secure support for the wing panels 5 and 72 in the open unfolded position to facilitate writing thereon. The header panels 70 and 72 provide three convenient display surfaces 78 & 87 on top of the three primary display surfaces 4 & 6 for topic headings, and the like.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A fold out display, comprising:

a base configured to support said display in a fleestanding fashion on an associated floor surface;

a primary panel fixedly supported on said base, and including opposite side edges between which a display surface extends on an exterior side thereof;

at least one foldable panel hingedly supported on said primary panel for movement between a closed folded position wherein said foldable panel generally overlies said primary panel, and an open unfolded position wherein said foldable panel extends generally outwardly of said primary panel in a substantially coplanar relationship therewith; said foldable panel including opposite side edges between which a display surface extends on an interior side thereof, which is disposed adjacent to the exterior side of said primary panel when said foldable panel is in the closed folded position;

a panel outstop telescopingly mounted in said base for lateral translation between a retracted storage position, and an extended stop position, wherein said outstop engages said foldable panel in the open unfolded position to resist rearward movement therefrom.

2. A display as set forth in claim 1, including:

a header panel fixedly supported on said base directly above said primary panel, and including opposite side edges between which a display surface extends on an exterior side thereof;

at least one foldable header panel hingedly supported on said header panel for movement between a closed folded position wherein said foldable header panel generally overlies said header panel, and an open unfolded position wherein said foldable header panel extends generally outwardly of said header panel in a substantially coplanar relationship therewith; said foldable header panel including opposite side edges between which a display surface extends on an interior side thereof, which is disposed adjacent to the exterior side of said header panel when said foldable header panel is in the closed folded position; and wherein said outstop in said extended stop position is configured to engage said foldable header panel in the unfolded position to resist rearward movement therefrom.

3. A display as set forth in claim 2, wherein:

said outstop includes releasable catches for selectively retaining said foldable panel, and said foldable header panel in the open unfolded position.

4. A display as set forth in claim 3, wherein:

said outstop catches comprise resilient fingers which releasably engage an upper edge of said foldable panel and a lower edge of said foldable header panel.

5. A fold out display, comprising:

a base configured to support said display in a freestanding fashion on an associated floor surface;

a primary panel fixedly supported on said base, and including opposite side edges between which a display surface extends on an exterior side thereof;

at least one foldable panel hingedly supported on said primary panel for movement between a closed folded position wherein said foldable panel generally overlies said primary panel, and an open unfolded position wherein said foldable panel extends generally outwardly of said primary panel in a substantially coplanar relationship therewith; said foldable panel including opposite side edges between which a display surface extends on an interior side thereof, which is disposed adjacent to the exterior side of said primary panel when said foldable panel is in the closed folded position;

a one-piece living hinge, having opposite side portions thereof connected with adjacently positioned ones of the side edges of said primary panel and said foldable panel, and a flexible center portion disposed therebetween shaped such that when said foldable panel is shifted to the open unfolded position, the display surface on said primary panel and the display surface on said foldable panel are juxtaposed in a substantially contiguous relationship to collectively provide an enlarged generally continuous and uninterrupted display; and wherein said primary panel and said foldable panel each has a borderless construction.

6. A display as set forth in claim 5, wherein:

said display surface on said primary panel and display surface on said foldable panel are erasable marker surfaces, and permit marking indicia continuously thereacross.

7. A display as set forth in claim 5, including:

a panel outstop telescopingly mounted on said base for lateral translation between a retracted storage position, and an extended stop position, wherein said outstop engages said foldable panel in the open unfolded position to resist rearward movement therefrom.

8. A display as set forth in claim 5, including:

a header panel fixedly supported on said base directly above said primary panel, and including opposite side edges between which a display surface extends on an exterior side thereof.

9. A display as set forth in claim 5, wherein:

said primary panel and said foldable panel are each marker boards.

10. A fold out display, comprising:

a base configured to support said display in a freestanding fashion on an associated floor surface;

a primary panel fixedly supported on said base, and including opposite side edges between which a display surface extends on an exterior side thereof;

at least one foldable panel hingedly supported on said primary panel for movement between a closed folded position wherein said foldable panel generally overlies said primary panel, and an open unfolded position wherein said foldable panel extends generally outwardly of said primary panel in a substantially coplanar relationship therewith; said foldable panel including opposite side edges between which a display surface extends on an interior side thereof, which is disposed adjacent to the exterior side of said primary panel when said foldable panel is in the closed folded position;

a one-piece living hinge, having opposite side portions thereof connected with adjacently positioned ones of the side edges of said primary panel and said foldable panel, and a flexible center portion disposed therebetween shaped such that when said foldable panel is shifted to the open unfolded position, the display surface on said primary panel and the display surface on said foldable panel are juxtaposed in a substantially contiguous relationship to collectively provide an enlarged generally continuous and uninterrupted display; and a panel outstop telescopingly mounted on said base for lateral translation between a retracted storage position, and an extended stop position, wherein said outstop engages said foldable panel in the open unfolded position to resist rearward movement therefrom.

11. A display as set forth in claim 10, wherein:

said display surface on said primary panel and the display surface on said foldable panel are erasable marker surfaces, and permit marking indicia continuously thereacross.

12. A display as set forth in claim 11, including:

a header panel fixedly supported on said base directly above said primary panel, and including opposite side edges between which a display surface extends on an exterior side thereof.

13. A display as set forth in claim 12, including:

at least one foldable header panel hingedly supported on said header panel for movement between a closed folded position wherein said foldable header panel generally overlies said header panel, and an open unfolded position wherein said foldable header panel extends generally outwardly of said header panel in a substantially coplanar relationship therewith; said foldable header panel including opposite side edges between which a display surface extends on an interior side thereof, which is disposed adjacent to the exterior side of said header panel when said foldable header panel is in the closed folded position.

14. A display as set forth in claim 13, including:

a one-piece living hinge, having opposite side portions thereof connected with adjacently positioned ones of the side edges of said header panel and said foldable header panel, and a flexible center portion disposed therebetween shaped such that when said foldable header panel is shifted to the open unfolded position, the display surface on said header panel and the display surface on said foldable header panel are juxtaposed in a substantially contiguous relationship to collectively provide an enlarged substantially continuous and uninterrupted header display.

15. A display as set forth in claim 14, wherein:

said display surface on said header panel and the display surface on said foldable header panel are erasable marker surfaces, and permit marking indicia continuously there across.

16. A display as set forth in claim 15, wherein:

said outstop in said extended stop position is configured to engage said foldable header panel in the unfolded position to resist rearward movement therefrom.

17. A display as set forth in claim 16, wherein:

said primary panel, said foldable panel, said header panel and said foldable header panel each have a borderless construction.

18. A display as set forth in claim 17, wherein:

said primary panel, said foldable panel, said header panel and said foldable header panel are each marker boards.

19. A display as set forth in claim 18, wherein:

said primary panel has a predetermined height, and a predetermined width; and said foldable panel has a height generally equal to the height of said primary panel, and a width equal to substantially one-half of the width of said primary panel.

20. A display as set forth in claim 19, wherein:

said foldable panel defines a first foldable panel; and including a second foldable panel, substantially identical to said first foldable panel, and hingedly supported on said primary panel opposite said first foldable panel for movement between a closed folded position wherein said second foldable panel generally overlies said primary panel, and an open unfolded position wherein said second foldable panel extends generally outwardly of said primary panel in a substantially coplanar relationship therewith.

21. A display as set forth in claim 20, including:

a one-piece living hinge, having opposite side portions thereof connected with adjacently positioned side edges of said primary panel and said second foldable panel, and a flexible center portion disposed therebetween shaped such that when said second foldable panel is shifted to the open unfolded position, the display surface on said primary panel and the display surface on said second foldable panel are juxtaposed in a substantially contiguous relationship to collectively provide an enlarged substantially continuous and uninterrupted display.

22. A display as set forth in claim 21, including:

said outstop defines a first outstop associated with said first foldable panel; and including a second panel outstop telescopingly mounted in said base for lateral translation between a retracted storage position, and an extended stop position, wherein said outstop engages said second foldable panel in the unfolded position to resist rearward movement therefrom.

23. A display as set forth in claim 22, wherein:

said header panel has a predetermined height that is less than the height of said primary panel, and a predetermined width that is substantially equal to the width of said primary panel.

24. A display as set forth in claim 23, wherein:

said foldable header panel has a height generally equal to the height of said header panel, and a width equal to substantially one-half of the width of said header panel.

25. A display as set forth in claim 24, wherein:

said foldable header panel defines a first foldable header panel; and including a second foldable header panel, substantially identical to said first foldable header panel, and hingedly supported on said header panel opposite said first foldable header panel for movement between a closed folded position wherein said second foldable header panel generally overlies said header panel, and an open unfolded position wherein said second foldable header panel extends generally outwardly of said header panel in a substantially coplanar relationship therewith.

26. A display as set forth in claim 25, including:

a one-piece living hinge, having opposite side portions thereof connected with adjacently positioned ones of the side edges of said header panel and said second foldable header panel, and a flexible center portion disposed therebetween shaped such that when said second foldable header panel is shifted to the open unfolded position, the display surface on said header panel and the display surface on said second foldable header panel are juxtaposed in a substantially contiguous relationship to collectively provide an enlarged substantially continuous and uninterrupted header display.

27. A display as set forth in claim 26, wherein:

said display surface on said second foldable panel and the display surface on said second foldable header panel are erasable marker surfaces.

28. A display as set forth in claim 27, wherein:

said second outstop in said extended stop position is configured to engage said second foldable header panel in the unfolded position to resist rearward movement therefrom.

29. A display as set forth in claim 28, wherein:

said living hinge is relatively thin at said opposite side portions, and has a reduced thickness at said center portion for improved flexure.

30. A display as set forth in claim 29, wherein:

said living hinge comprises a strip which generally extends continuously along at least a major portion of the adjacent side edges of said primary panel and said first and second foldable panels.

31. A display as set forth in claim 30, wherein:

said living hinge comprises a strip which generally extends continuously along at least a major portion of the adjacent side edges of said header panel and said first and second foldable header panels.

32. A display as set forth in claim 31, wherein:

said first and second outstops include releasable catches for selectively retaining said first and second foldable panels, and said first and second foldable header panels in the open unfolded position.

33. A display as set forth in claim 32, wherein:

said first and second foldable panels each include a display surface on an exterior side thereof, which is exposed when said foldable panels are in the closed folded position.

34. A display as set forth in claim 33, wherein:

said display surface on the exterior side of each of said first and second foldable panels is an erasable marker surface.

35. A display as set forth in claim 34, including:

a first hanger rail extending along a top edge of said primary panel.

36. A display as set forth in claim 35, including:

a second hanger rail extending along a top edge of said header panel.

37. A display as set forth in claim 36, wherein:

said base includes casters for movably supporting said display on the floor surface.

38. A display as set forth in claim 37, wherein:

said primary panel and said first and second foldable panels are disposed in a rearwardly inclined orientation; and said header panel and said first and second foldable header panels are disposed in a generally vertical orientation.

39. A display as set forth in claim 38, wherein:

each said living hinge has a dual durometer construction, wherein said center portion has improved flexure.

40. A display as set forth in claim 1, wherein:

said primary panel and said foldable panel each has a borderless construction.

41. A display as set forth in claim 1, wherein:

said primary panel and said foldable panel are each marker boards.

42. A display as set forth in claim 1, including:

a header panel fixedly supported on said base directly above said primary panel, and including opposite side edges between which a display surface extends on an exterior side thereof.

43. A display as set forth in claim 42, wherein:

said primary panel and said foldable panel are disposed in a rearwardly inclined orientation; and said header panel is disposed in a generally vertical orientation.

44. A display as set forth in claim 43, including:

at least one foldable header panel hingeally supported on said header panel for movement between a closed folded position wherein said foldable header panel generally overlies said header panel, and an open unfolded position wherein said foldable header panel extends generally outwardly of said header panel in a substantially coplanar relationship therewith; said foldable header panel including opposite side edges between which a display surface extends on an interior side thereof, which is disposed adjacent to the exterior side of said header panel when said foldable header panel in the closed folded position.

45. A display as set forth in claim 44, wherein:

said outstop in said extended stop position is configured to engage said foldable header panel in the unfolded position to resist rearward movement therefrom.

46. A display as set forth in claim 1, wherein:

said primary panel has a predetermined height, and a predetermined width;

said foldable panel has a height generally equal to the height of said primary panel, and a width equal to substantially one-half of the width of said primary panel;

said foldable panel defines a first foldable panel; and including a second foldable panel, substantially identical to said first foldable panel, and hingeally supported on said primary panel opposite said first foldable panel for movement between a closed folded position wherein said second foldable panel generally overlies said primary panel, and an open unfolded position wherein said second folded panel extends generally outwardly of said primary panel in a substantially coplanar relationship therewith.

47. A display as set forth in claim 1, wherein:

said living hinge has a reduced thickness at said center portion for improved flexure.

48. A display as set forth in claim 1, wherein:

said living hinge has a dual durometer construction.

49. A display as set forth in claim 1, wherein:

said living hinge comprises a strip which generally extends continuously along at least a major portion of the adjacent side edges of said primary panel and said foldable panel.

50. A display as set forth in claim 1, wherein:

said foldable panel has a display surface on an exterior side thereof, which is exposed when said foldable panel is in the closed folded position.

51. A display as set forth in claim 50, wherein:

said display surface on the exterior side of said foldable panel is an erasable marker surface.

* * * * *

UNITED STATES PATENT AND TRADEMARK OFFICE

CERTIFICATE OF CORRECTION

PATENT NO. : 5,492,476

DATED : February 20, 1996

INVENTOR(S) : Douglas C. Ball, et al.

It is certified that error appears in the above-indentified patent and that said Letters Patent is hereby corrected as shown below:

Column 7, line 52;
"maintain" should be –maintaining–.

Column 9, claim 1, line 63;
"fleestanding" should be –freestanding–.

Column 14, claim 44, line 64;
"hingeally" should be –hingedly–.

Signed and Sealed this

Tenth Day of September, 1996

*Attest:*

Bruce Lehman

BRUCE LEHMAN

*Attesting Officer*

*Commissioner of Patents and Trademarks*